US007320814B2

(12) United States Patent
Blincoe et al.

(10) Patent No.: US 7,320,814 B2
(45) Date of Patent: Jan. 22, 2008

(54) METHODS FOR APPLYING A LIQUID TO A WEB

(75) Inventors: Gregory M. Blincoe, Paris, TX (US); Kent A. Franklin, Neenah, WI (US); Scott Delzer, Greenville, WI (US); Arch Morgan, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 817 days.

(21) Appl. No.: 10/742,549

(22) Filed: Dec. 19, 2003

(65) Prior Publication Data

US 2005/0136189 A1 Jun. 23, 2005

(51) Int. Cl.
*B05D 1/02* (2006.01)

(52) U.S. Cl. ..... 427/427.2; 427/8; 427/421.1

(58) Field of Classification Search ..... 427/427.2, 427/421.1, 8

See application file for complete search history.

(56) References Cited

U.S. PATENT DOCUMENTS 4,164,001 A 8/1979 Patnaude ..... 361/236
5,018,443 A 5/1991 Bolger ..... 101/228
5,322,706 A 6/1994 Merkel et al. ..... 427/8
5,683,752 A * 11/1997 Popp et al. ..... 427/8
6,246,916 B1 6/2001 VonDerHaar et al. ..... 700/11

* cited by examiner

*Primary Examiner*—Fred J. Parker
(74) *Attorney, Agent, or Firm*—Schwegman, Lundberg & Woessner, P.A.

(57) ABSTRACT

A method of spraying patterns on a web that includes directing at least one intermittent spray of liquid onto the web to form a pattern on the web; sensing a position of a leading edge of at least one of the spray and the pattern relative to one or more references on the web; generating a first correction signal when the leading edge is out of position; and adjusting the spray of liquid in response to the first correction signal to correctly position a leading edge of a subsequent pattern. The method further includes sensing a position of a trailing edge of at least one of the spray and the pattern relative to one or more references on the web; generating a second correction signal when the trailing edge is out of position; and adjusting the spray of liquid in response to the second correction signal to correctly position a trailing edge of subsequent patterns.

26 Claims, 4 Drawing Sheets

METHODS FOR APPLYING A LIQUID TO A WEB

FIELD OF THE INVENTION

This invention relates to methods for applying a liquid on a surface, and in particular to methods that spray an adhesive onto a moving surface of a web.

BACKGROUND OF THE INVENTION

Various systems are currently used to spray a liquid onto a web. One example system includes a plurality of nozzles that are connected to a single manifold. The manifold is typically connected to a large tank of liquid (e.g., an adhesive) that is spaced some distance from the manifold. The large tank of liquid is pressurized such that liquid is delivered from the tank to the manifold, and then to the individual nozzles.

Another example system includes a plurality of pumps that are connected between a plurality of nozzles and a large tank of liquid. The flow of liquid from the large tank to the nozzles is typically controlled by one valve that is between the tank and one of the respective pumps, and another valve that is between the respective pumps and corresponding nozzles. The nozzles may be operated all together, or only groups of the nozzles may be operated, depending on the pattern that is placed on the web.

Existing systems are unable instantaneously to spray liquid at a specific point in time because there is a time lag between when a control signal is sent to open any nozzles, valves and manifolds and when the liquid is actually dispensed from the nozzle. The systems are similarly unable to instantaneously stop spraying liquid because there is a time lag between when a control signal is sent to close any nozzles, valves and manifolds and when the liquid is no longer dispensed from the nozzle. Delays in spraying the liquid, and stopping the spray of liquid, result in the pattern being sprayed out of position on a continuously moving web.

A compensation factor is typically estimated manually and built into such systems to account for the delays in starting and stopping the spray of liquid. The compensation factor is fixed such that one drawback with existing methods is that they fail to account for changes in length of the delay that it takes to turn the nozzles on and off. The length of the "on" delay and the "off" delay can vary over time due to such factors as wear of the nozzles and other components (among other factors). Another drawback with existing methods is that the compensation factor is typically the same for the "on" delay and the "off" delay even though during operation the "on" delay is often times different from the "off" delay.

There are some methods that include monitoring the relative location of one edge of a sprayed pattern on a web. The monitoring is done to provide information to a control system that modifies when the respective nozzles are turned on.

One drawback with some existing methods is that they are limited to controlling either the leading or trailing edge of an adhesive pattern on a moving web. As a result, existing systems are limited in their ability to accurately register (i.e., position) patterns of spray on a moving web.

SUMMARY OF THE INVENTION

The present invention relates to methods and systems of spraying a liquid (e.g., an adhesive) in patterns on a moving web. The methods and systems described herein provide improved registration of the patterns on the web and compensates for delays that occur within the systems that are used to spray the patterns on the web.

In one example form, the invention relates to a method of spraying a liquid in patterns on a moving web. The method includes directing at least one intermittent spray of liquid onto the web to form a pattern on the web; sensing a position of a leading edge of at least one of the spray and the pattern relative to one or more references on the web; generating a first correction signal when the leading edge of the one pattern is out of position relative to the one or more references; and adjusting the spray of liquid in response to the first correction signal to correctly position a leading edge of a subsequent pattern relative to the one or more subsequent references on the web. The method further includes sensing a position of a trailing edge of at least one of the spray and the pattern relative to one or more references on the web; generating a second correction signal when the trailing edge of the one pattern is out of position relative to the one or more references; and adjusting the spray of liquid in response to the second correction signal to correctly position a trailing edge of subsequent patterns relative to one or more subsequent references on the web.

In some forms of the method, the leading edge of the pattern is sensed relative to a first reference on the web, and the trailing edge of the pattern is sensed relative to a second reference on the web. Although the leading and trailing edges of a pattern can be sensed after the pattern is sprayed on the web, it should be noted that the leading and trailing edges of a spray which becomes the pattern on the web can be also sensed (i.e., after the spray leaves a nozzle but before it is applied to the web). The pattern can be sensed thermally, optically and/or visually as long as the leading and trailing edges of the pattern can be located relative to one or more references on the web. Another example sensing method includes measuring surface roughness (i.e., changes in height of the web), such as by using ultrasonic sensors, displacement sensors and/or fiber-optic sensors.

In another example form, the invention relates to a method of spraying a liquid in patterns on a web. The method includes sending signals to a mechanism; spraying patterns of liquid onto the web using the mechanism when the mechanism receives the signals; measuring a delay between sending the signals and spraying the patterns of liquid; generating a correction factor based on the delay; and adjusting timing of the signals to the mechanism based on the correction factor.

In some forms of the method, sending signals to a mechanism includes sending signals from a programmable control to a plurality of nozzles. In addition, spraying patterns of liquid onto the web using the mechanism can include spraying an adhesive onto the web using a plurality of nozzles.

In some forms, measuring a delay between sending the signals and spraying the patterns of liquid can further include measuring a speed of the web; monitoring a first time when a signal is sent to the mechanism; sensing a second time when a portion of a pattern that is generated by the signal passes a sensor that is at a fixed point relative to the moving web; calculating a time difference between the first time and the second time; and calculating a web transport time. The web transport time being the amount of time it takes for a pattern on the web to move from the mechanism to the sensor. The delay can then be determined by subtracting the web transport time from the time difference.

In still another form there is provided a method of spraying a liquid in patterns on a web. The method includes sending an on signal to a mechanism; spraying a pattern of liquid onto the web using the mechanism when the mechanism receives the on signal; measuring an on delay between sending the signal to the mechanism and the mechanism spraying the pattern of liquid based on the signal; generating a first correction factor that correlates to the on delay; and adjusting timing of subsequent on signals to the mechanism based on the first correction factor.

The method further includes sending an off signal to the mechanism; stopping the spray of liquid onto the web when the mechanism receives the off signal; measuring an off delay between sending the off signal to the mechanism and the mechanism stopping the spray of liquid; generating a second correction factor that correlates to the off delay; and adjusting timing of subsequent off signals to the mechanism based on the second correction factor.

In some forms of the method, measuring an on delay can include measuring an amount of time between when the on signal is sent to the mechanism and the leading edge of the pattern is monitored by a sensor. In addition, measuring an off delay can include measuring an amount of time between when the off signal is sent to the mechanism and the trailing edge of the pattern is monitored by a sensor.

BRIEF DESCRIPTION OF THE DRAWINGS

The above-mentioned and other features will become more apparent and better understood by reference to the following description of the invention taken in conjunction with the accompanying drawings.

DEFINITIONS

Within the context of this specification, each term or phrase below will include the following meaning or meanings:

(a) "Pattern" includes any geometric or non-geometric form that can include, among others, a series of connected or unconnected lines or curves, a series of parallel or non-parallel or intersecting lines or curves, a series of linear or curvilinear lines, points or series of points, islands, blocks, strips, or any combinations thereof. The pattern can include a repeating form(s) and/or non-repeating form(s).

(b) "Spray" and variations thereof includes forcefully ejecting liquid, either as a stream, such as swirl filaments, or atomized droplets through an orifice, nozzle, or the like, by means of an applied pressure of air or other gas, by force of gravity, or by centrifugal force. The spraying may be continuous or non-continuous, and may involve one or more types of slot coat and/or drag bead applications (among others).

(c) "Liquid" includes a substance and/or material that flows and can assume the interior shape of a container into which it is poured or placed.

(d) "Web" includes any substrate, including by way of example, paper, woven material, nonwoven material, polymeric material, laminates of one or more types of material, and combinations thereof.

(e) "Reference" includes structure such as waist or leg elastics, adhesive material, corners or edges of structure, transporting medium such as conveyor belts, visual marks, magnetic marks, color marks, water-based marks, or other marks that can be sensed or measured.

(f) "Leading and Trailing Edges" means the leading and trailing edges of a moving pattern or component as sensed by a sensing system as the pattern or component passes the sensing system.

DESCRIPTION OF THE INVENTION

Figure 1:
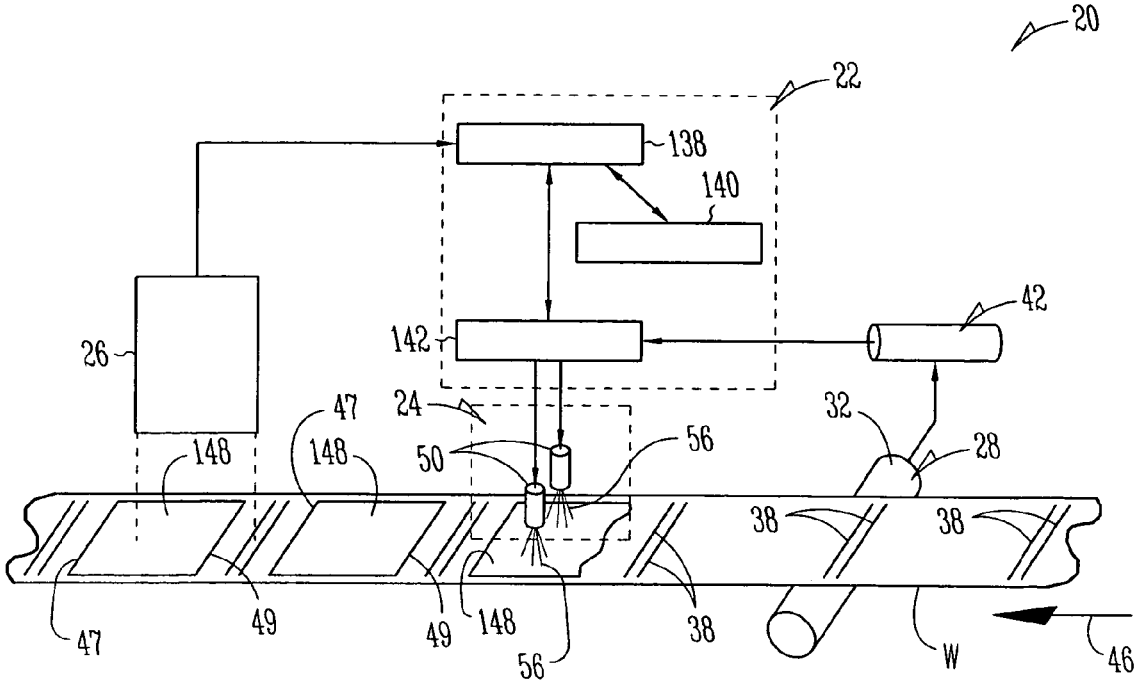
FIG. 1 is a schematic perspective view illustrating an example system for implementing some of the methods of the present invention.

FIG. 1 illustrates an example system 20 that may be operated according to some sample methods of the present invention. The system 20 includes a programmable control 22 that is operatively connected to a mechanism 24 which sprays liquid on a web W. It should be noted that the mechanism 24 forms a spray 56 of liquid into any type of desired pattern on the moving web W. One example liquid that can be sprayed onto the web W is a hot melt adhesive. Other example liquids include cold liquid adhesives, lotions, perfumes, oils, inks, inks of different color, different types of adhesive melts, fiber-forming polymer melts, or any other combinations of desired liquids to be sprayed.

A conveyor system 28 can be positioned below mechanism 24. The conveyor system 28 includes a conveyor roller 32 that can be driven continuously to maneuver the web W under mechanism 24.

The illustrated example system 20 further includes a sensor system 26 that is operatively connected to programmable control 22. The sensor system 26 senses the relative location of a pattern 148 that is formed by the spray 56 of liquid on web W, and generates a signal that is sent to the programmable control 22.

Web W can include any type of layer or material, such as films of thermoplastic material, a non-woven web of thermoplastic material or a combination of thermoplastic material and natural fibers such as wood pulp fluff fibers, woven webs made of strands of thermoplastic material, natural material such as threads of cotton and the like, or combinations thereof. As will be described hereafter in more specific terms, web W has a liquid, such as an adhesive, sprayed onto it in a specific pattern. The web W can then be joined to another component or another web. In addition, the web may include a conveyor that has discrete items located along the length of the conveyor. The items may be removed from the conveyor and placed onto a moving layer(s) that form another web.

Web W includes a plurality of references 38 that can be detected by sensor system 26. Example references include some type of mark, signal, component or location that can be sensed, measured, or the like, and in response thereto a signal can be generated by sensor system 26. In the illustrated example system 20, references 38 are a plurality of waist elastics that are disposed on web W. Other example references could include marking the web W with different colors, magnetic marks, or the like.

In some example systems, a timing mechanism 42 can be mechanically coupled to conveyor roller 32 and operatively connected to programmable control 22. In some forms, timing mechanism 42 is a resolver that translates one revolution of the conveyor roller 32 into one product length. The resolver also generates a signal that is sent to the programmable control 22. In the example system illustrated in FIG. 1, the product length is the distance between a centerline of one pair of references 38 and a centerline of an adjacent pair of references 38. Thus, a pair of references 38 on web W can indicate to resolver 42 that a product length has been initiated or started. The resolver 42 then sends an appropriate signal to programmable control 22.

One example resolver 42 can be adjusted such that one rotation of conveyor roller 32 is any a fraction or a multiple of a product length. As an example, one rotation of conveyor roller 32 can be translated into one-half a product length or twice a product length, and similarly one-half rotation of conveyor roller 32 can be translated into any fraction or multiple of product lengths. In other forms of the system, different devices (see, e.g., sensor 80 in FIG. 3) can be used between web W and programmable control 22 to provide signals to programmable center 22 that a product length has been initiated.

Figure 2:
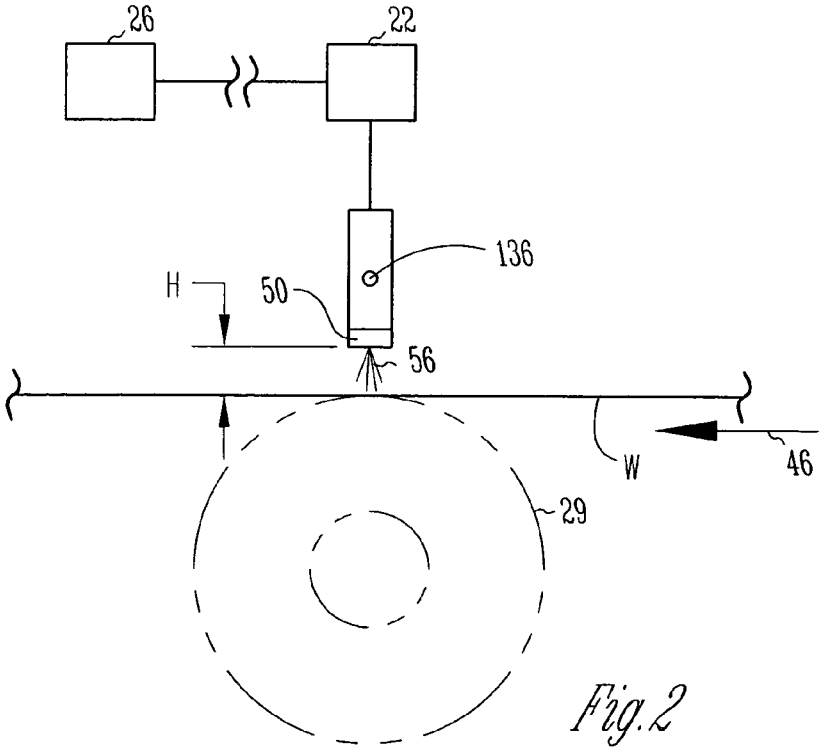
FIG. 2 is a schematic side view illustrating a portion of the example system shown in FIG. 1.

In the example embodiment illustrated in FIGS. 1 and 2, mechanism 24 includes a plurality of nozzles 50. Although two nozzles 50 are shown, mechanism 24 may include any number and configuration of nozzles. Some example types of nozzles include swirl spray, meltblown, slot-coat and/or drag-bead. One example nozzle 50 that is suitable for operation with the methods of the present invention is obtainable from ITW Dynatec Co. of Hendersonville, Tenn., and has part number 057B1639, I.D. #A3.

One mechanism that may be used to spray liquid upon receiving signals from programmable control is described in U.S. Pat. No. 5,683,752, which issued Nov. 4, 1997, to the assignee of this application, and is entitled "Apparatus and Methods for Selectively Controlling a Spray of Liquid to Form a Distinct Pattern". U.S. Pat. No. 5,683,752 is incorporated by reference herein.

In some forms, one source of liquid supplies each nozzle 50, while in other forms each nozzle 50 has its own source of liquid. It should be noted that mechanism 24 may include any combination of nozzles, solenoids, valves, heaters and pumps.

As shown in FIG. 1, programmable control 22 can include a computer 138, a programmable limit switch 142, and an interface 140. The computer 138 is operatively connected to the programmable limit switch 142 and the interface 140. Interface 140 provides general input/output capability to the computer 138. The interface 140 may be a visual basic program or other industry standard human-machine interface (HMI) program.

The programmable limit switch 142 can include an electronic cam switch that duplicates the functions of a rotary cam switch. As an example, the programmable limit switch 142 can consist of a position transducer (e.g., an encoder), a programmable control unit and interface software. The position transducer, in some sample programmable limit switches, produces 1000 counts per product on a web such that a particular encoder count value represents the same relative point on each product. The computer 138 instructs the programmable limit switch 142 to turn the mechanism 'on' and 'off' at specific encoder count values. One example programmable limit switch 142 is made by Namco Controls, an Acme-Cleveland Company, of Mentor, Ohio, and identified as C&A Programmable Limit Switch No. CA410-23000.

Figure 3:
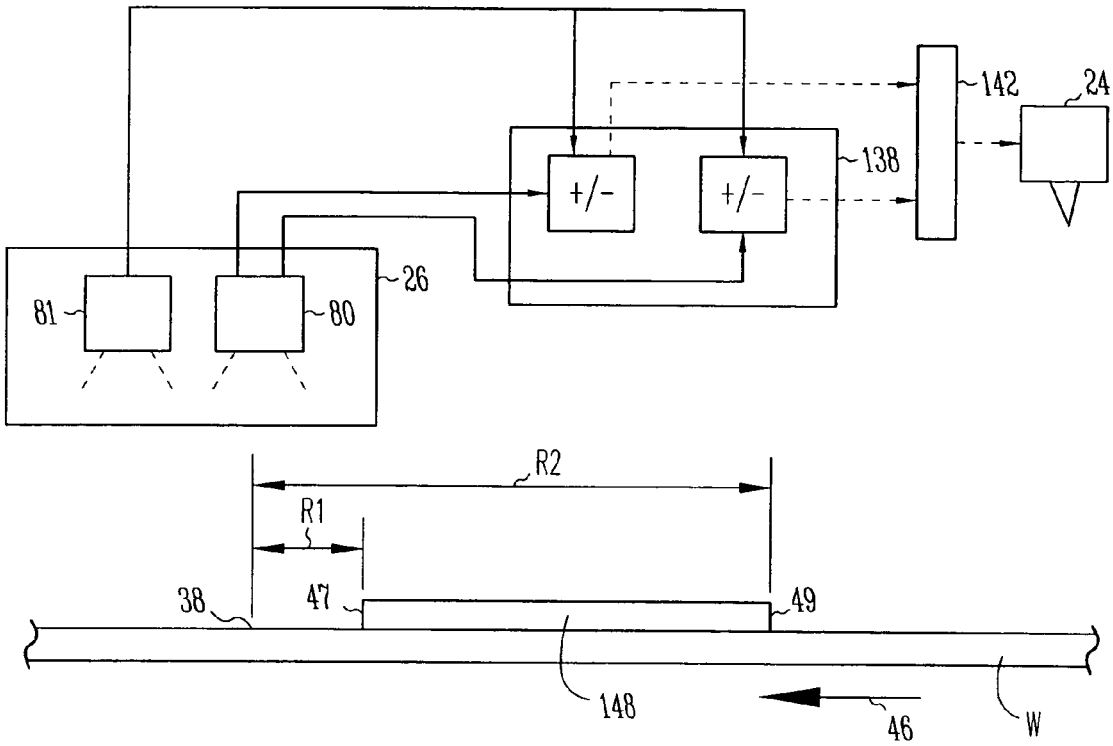
FIG. 3 is a schematic view illustrating a portion of an example control that may be used in the system shown in FIG. 1.

An example method of spraying a liquid in patterns on a moving web W will now be described with reference to FIGS. 1-3. Conveyor roller 32 moves the web W in the direction of arrow 46 such that the web W moves past sensor system 26. The method includes directing at least one intermittent spray 56 of liquid onto the web W to form a pattern 148 on the web W. The leading and trailing edges of at least one of the spray 56 and the pattern 148 are sensed relative to one or more references 38 on the web W. In some forms, sensor system 26 detects a position of a leading edge 47 of the pattern 148 relative to one or more references 38 on the web W. The sensor system 26 sends a signal that is representative of the relative position of the leading edge 47 to the computer 138.

Based on one or more signals received from the sensor system 26, the computer 138 determines whether one or more of the leading edges 47 of the adhesive patterns 148 are out of position. If the leading edges 47 of the adhesive patterns 148 are out of position, the computer 138 calculates a first correction signal according to preprogrammed instructions that are within the computer 138. The computer 138 encodes a signal that corresponds to the first correction factor and sends it to programmable limit switch 142.

Based on the first correction signal, the programmable limit switch 142 adjusts the position of the leading edge 47 on a subsequent 148 pattern relative to one or more subsequent references 38 on the web W. The programmable limit switch 142 adjusts the spray 56 of liquid that forms the pattern 148 by opening one or more nozzles 50 sooner or later depending on the first correction factor.

The method may further include using sensor system 26 to sense a position of a trailing edge 49 of the pattern 148 relative to one or more references 38 on the web W. The sensor system 26 sends a signal that is representative of the position of the trailing edge 49 to the computer 138.

Based on the signal received from the sensor system 26, the computer 138 determines whether the trailing edge 49 of the adhesive pattern 148 is out of position. If the trailing edge 49 of the adhesive pattern 148 is out of position, the computer 138 calculates a second correction factor that is sent to the programmable limit switch 142.

The programmable limit switch 142 receives the signal from the computer 138, and according to preprogrammed instructions adjusts the operational timing of any one or more of nozzles 50 to correctly position the trailing edge 49 of a subsequent 148 pattern on the web W relative to one or more subsequent references 38. The programmable limit switch 142 adjusts the operational timing of the nozzles 50 by closing one or more nozzles 50 sooner or later depending on the second correction factor.

In some forms of the method of the present invention, sensing the position of the leading and trailing edges 47, 49 of the pattern 148 can include sensing a position of a leading edge 47 of a pattern 148 relative to one reference 38 on the web W and sensing the position of the trailing edge 49 of the pattern 148 relative to a different reference 38 on the web W. In other forms, the position of the leading and trailing edges 47, 49 of a pattern 148 can be sensed relative to the same reference 38 on the web W (see e.g., R1 and R2 in FIG. 3).

In some forms, sensing a position of the leading and trailing edges 47, 49 of the pattern 148 includes sensing differences in thermal energy between the pattern 148 and the web W. As shown in FIG. 3, sensor system 26 can include one sensor 80 that detects the leading and trailing edges 47, 49 of an adhesive pattern, and another sensor 81 that detects the references 38 on the web W.

Some example sensors 80 are TH-11CS or TH-12CS hot melt glue sensors manufactured by SUNX Sensors USA of West Des Moines, Iowa. The sensors 80 can be used to provide position signals which represent the position of the leading and trailing edges 47, 49 of the pattern 148. The respective signals are used to register the leading and trailing edges 47, 49 of subsequent patterns relative to references 38. Registering both the leading and trailing edges 47, 49 of the pattern 148 allows the system 20 to more accurately account for delays within the system 20. As an example, controlling the leading and trailing edges 47, 49 of the pattern 148 according to the method provides independent registration loops for the leading and trailing edges 47, 49 of the patterns 148.

Figure 4:
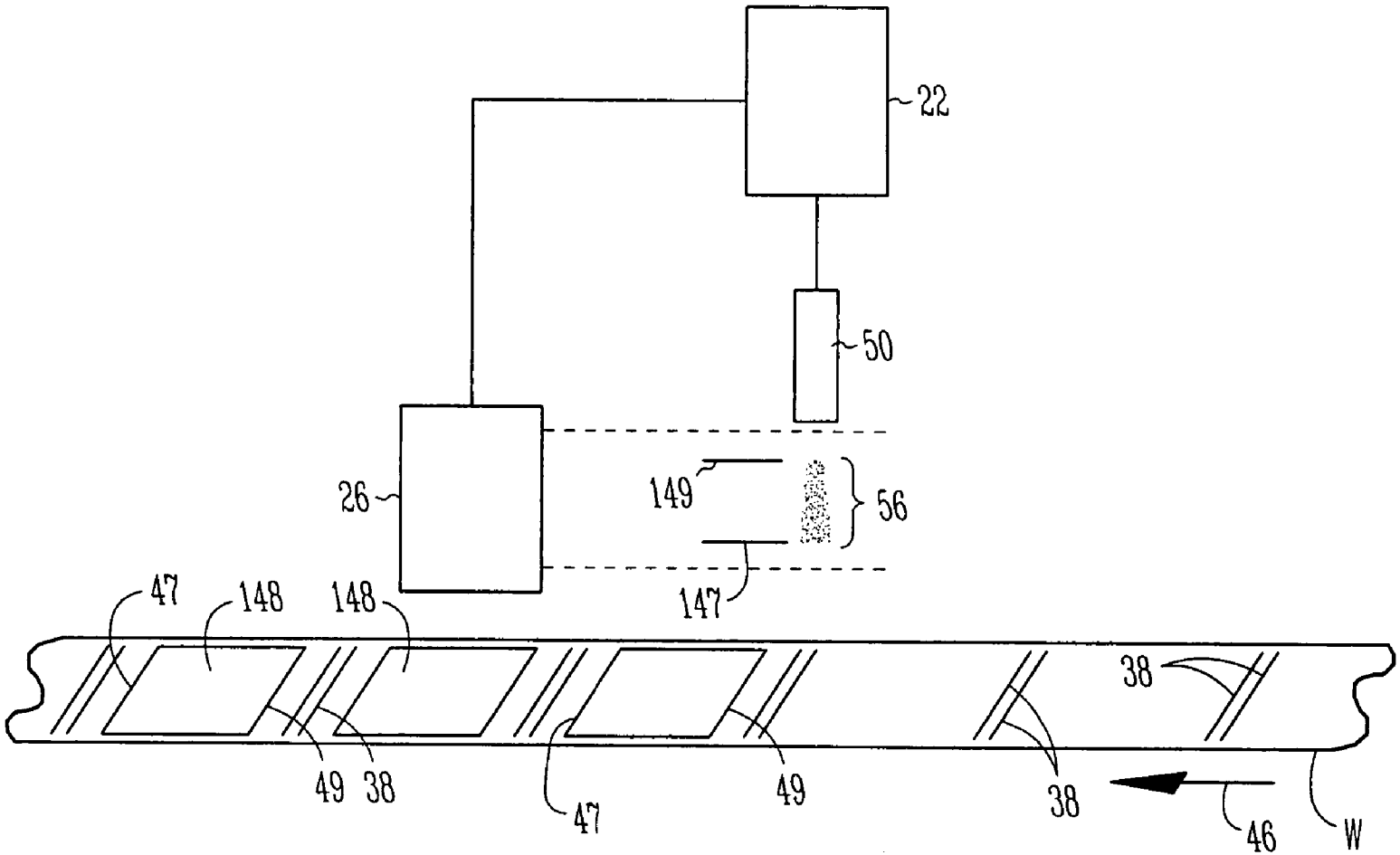
FIG. 4 is a schematic perspective view illustrating a portion of another example control that may be used in the system shown in FIG. 1.

FIG. 4 shows an alternative form of the method where a spray 56 which becomes a pattern 148 on the web is sensed by a sensor system 26. In some forms, the sensor system 26 detects a leading edge 147 and a trailing edge 149 in each intermittent spray 56 that is delivered from nozzles 50. The leading edge 147 and the trailing edge 149 of spray 56 may be sensed in any manner, including optically sensing. One example optical sensor is Keyence LV Series Digital Laser Optic Sensor manufactured by Keyence Corporation of Wood Cliff Lake, N.J. When an optical sensor is used, the positions of the leading and trailing edges 47, 49 of a pattern 148 in the web W are inferred based on the relative time that the leading and trailing edges 147, 149 of spray 56 are sensed by the sensor system 26.

In other forms of the method, sensing a position of the leading and trailing edges 47, 49 of the pattern 148 includes obtaining visual images of the pattern 148 on the web W. One example visual sensor is an Insight Vision system manufactured by Cognex Corporation of Natick, Mass. The Insight Vision system can be used to monitor the patterns 148 on the web W by illuminating the web W with one or more lighting methods.

Even though the references 38 are described as being on the web W before the mechanism 24 sprays the patterns 148 on web W, the sequence can be reversed such that mechanism 24 sprays the pattern 148 on the web W before the references 38 are disposed on the web W. The position of the pattern 148 on the web W relative to the references 38 can then be monitored as described above.

As illustrated in FIG. 2, web W can be delivered over a chill roll 29 such that when hot liquid (e.g., an adhesive) is applied to the web W, the chill roll 29 helps to prevent the hot liquid from melting the web W or from migrating from the desired position on the web W. A heater cartridge 136 (FIG. 2) can be used to keep the liquid at a proper temperature thereby maintaining the liquid at a viscosity suitable for spraying. In some forms, the web W is ¾ inch from the mechanism (see dimension H in FIG. 2).

Although the invention has been described as spraying liquid adhesives, other types of liquids can be utilized with the method. As an example, certain nozzles 50 can spray one type of adhesive, while other nozzles 50 spray a different type of adhesive. In addition, other liquids are contemplated, such as lotions, perfumes, inks, different colored inks, or combinations of inks, fiber-forming polymer melts, or any other type of desired liquid that can be sprayed. If different types of liquids are used, more than one type of nozzle 50 may be needed to accommodate the different liquids.

The adhesive patterns 148 can be moved to the left, right, up or down relative to one or more references on the web W. In addition, the pattern 148 can be lengthened or narrowed, or any combination thereof, by programming the programmable control 22 via interface 140 with appropriate instructions. It should be noted that pattern 148 can have any design, such as a rectangular or hourglass design and can be a continuous or intermittent pattern, or any combination thereof. Several example patterns are shown and described in U.S. Pat. No. 5,683,752, which issued Nov. 4, 1997, to the assignee of this application, and is entitled "Apparatus and Methods for Selectively Controlling a Spray of Liquid to Form a Distinct Pattern".

Figure 5:
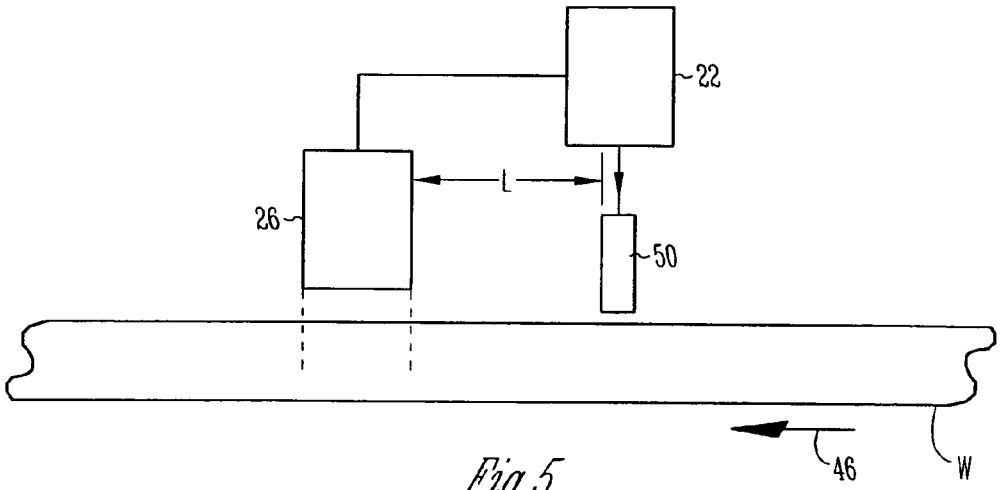
FIGS. 5-7 are schematic views illustrating a portion of still another example control that may be used to determine system delays that are associated with spraying pattern on a web.

Another example method of spraying a liquid in patterns on a web will now be described with reference to FIGS. 5-7. The method includes sending signals to a mechanism, such as nozzle 50, and spraying patterns 148 of liquid onto the web W using the nozzle 50 upon receiving the signals. The method further includes measuring a delay between sending the signals and spraying the patterns 148 of liquid onto the web W. A correction factor is then generated based on the delay to adjust the timing of the signals to the nozzle 50.

In some sample forms of the method, spraying the liquid onto the web W using the nozzle 50 can include spraying an adhesive onto the web W using a plurality of nozzles. It should be noted that generating a correction factor can include calculating the correction according to preprogrammed instructions within a programmable control 22 that sends the signals to the nozzle 50.

The method improves registration of the patterns 148 by automatically adjusting for changes in the spraying delays that are associated with operating the system 20. As an example, the delays associated with turning one or more nozzles 50 on and/or off can change due to degradation of mechanical components (e.g., nozzles, valves and pump) within the system 20.

In some forms of the method, the delay is the time between sending a signal to the nozzles 50 and the time that the spray 56 hits the web W. In other forms, the delay may be the time between sending signals to the nozzles and when the spray 56 leaves the nozzles 50.

The method constantly measures delays associated with spraying patterns on the web to create a continuously updated correction factor that changes the precise moment at which the nozzles 50 are commanded to spray thereby ensuring the proper positioning of the patterns 148 relative to the references 38 on the web W. Furthermore, the correction factor continuously takes into account web speed changes during operation.

As an example, when the machine speed changes, it is useful to adjust the precise time at which the nozzle 50 is commanded to spray so that the pattern is properly positioned relative to the references 38 on the web W. This method is useful in compensating for delays during machine speed changes thereby minimizing the number of web-related products that need to be discarded to maintain product quality.

In some forms, the method uses sensor system 26 feedback, web speed information, and distance measurements to determine the delays within the system 20. Based on the calculated delays, a compensation factor is calculated that allows for better registration control. Registration control is enhanced because any changes in the delays within the system 20 are being compensated for by the method.

Measuring the delay between sending the signals and spraying the patterns of liquid can be done using a variety of processes. As shown in FIGS. 5-7, one example process includes measuring the web W speed and then monitoring when a signal is sent to a mechanism, such as nozzle 50. Sensor system 26 monitors when a portion of a pattern 148 that is generated by the signal passes a known fixed point relative to the moving web W. Based on the signal from the sensor system 26, programmable control 22 calculates a time difference between generating the signal and when the portion of the pattern 148 passes sensor system 26.

The system 20 also calculates a web transport time, which is the amount of time it takes for a pattern 148 on the web W to move from the mechanism 24 to the sensor system 26. The web transport time is subtracted from the time difference to determine the delay. It should be noted that the web transport time depends in part on the web W speed and the distance L between the nozzle 50 and the sensor system 26. In some forms of the method, calculating the time difference and the web transport time can include calculating the time difference and the web transport time according to preprogrammed instructions within the programmable control 22 that sends signals to the nozzle 50.

It should be noted that any portion of the pattern 148 may be monitored by sensor system 26 in the example methods described herein. Some example portions of the pattern include leading and/or trailing edges 47, 49 of the pattern 148 (see, e.g., FIGS. 6 and 7 respectively). The portion of the pattern 148 can be sensed according to any of methods described above (e.g., thermal, optical or visual), or otherwise known in the art, including methods discovered in the future.

Another example method of spraying a liquid in patterns on a web will now be described with reference to FIGS. 5-7. The method includes sending an on signal to a mechanism, such as nozzle 50, and spraying a pattern 148 of liquid onto the web W using the nozzle 50 when the nozzle 50 receives the on signal. The method further includes measuring an on delay between sending the signal to the nozzle 50 and spraying the patterns 148 of liquid using the nozzle 50. A first correction factor is generated that correlates to the on delay. Based on the first correction factor, a programmable control 22 adjusts the timing of subsequent on signals that are sent to the nozzle 50.

The example method further includes sending an off signal to the nozzle 50 and stopping the spray of liquid onto the web W when the nozzle 50 receives the off signal. The method further includes measuring an off delay between sending the off signal to the nozzle 50 and stopping the spray of liquid from the nozzle 50. A second correction factor is generated that correlates to the off delay. Based on the second correction factor, a programmable control 22 adjusts the timing of subsequent off signals that are sent to the nozzle 50.

Figure 6:
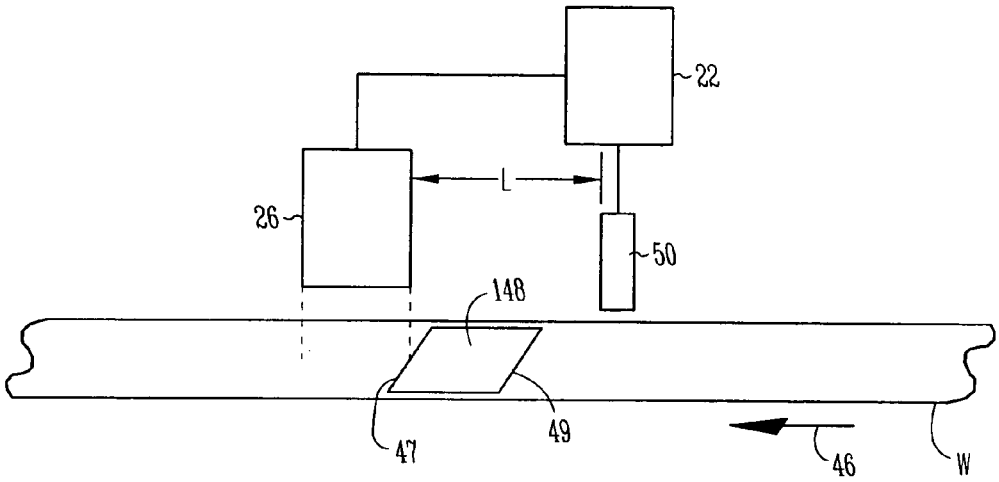
Figure 7:
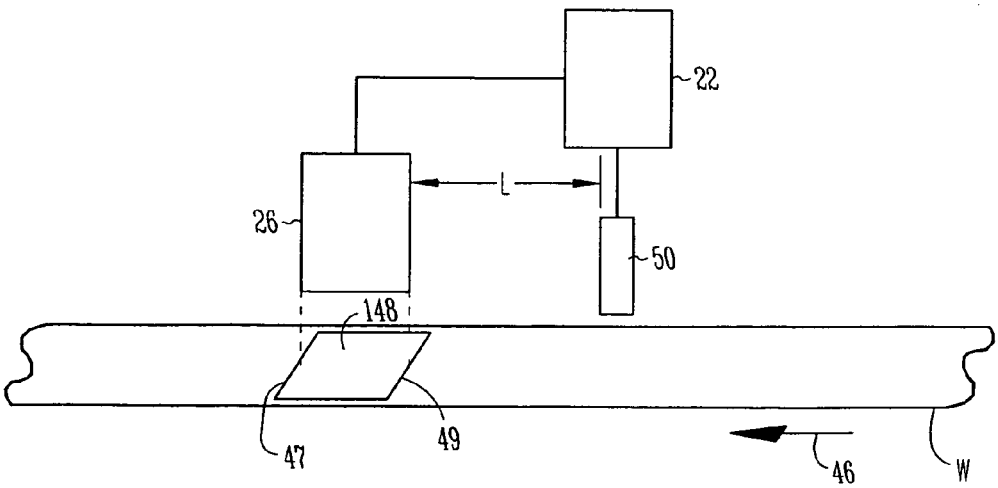

In some forms of the method, measuring an on delay includes measuring an amount of time between when the on signal is sent to the nozzle 50 and the leading edge 47 of the pattern 148 is monitored by sensor system 26 (see FIG. 6). In addition, measuring an off delay can include measuring an amount of time between when the off signal is sent to the nozzle 50 and the trailing edge 49 of the pattern 148 is monitored by sensor system 26.

The method uses information provided by sensor system 26 to establish individual compensation factors for the leading and trailing edges 47, 49 of the pattern 148. In one form of the method, the distance L between the nozzle 50 and the sensor system 26 is less than one product length, although if a buffering system is available, L may be greater than one product length.

The method improves registration control during web speed changes. In addition, both the "On" and "Off" delays can be individually and continuously calculated to provide automatic compensation for the changing delays within a system. Automatically compensating for the changing delays within a system improves registration of the patterns 148 on web W.

In other example forms of the method, measuring an on delay includes measuring an amount of time between when the on signal is sent to one or more nozzles 50 and the leading edge 147 of a spray 56 (which becomes a pattern 148 on the web) is detected by a sensor system 26 (see FIG. 4). In addition, measuring an off delay can include measuring an amount of time between when the off signal is sent to the one or more nozzles 50 and the trailing edge 149 of a spray 56 (which becomes a pattern 148 on the web) is detected by sensor system 26.

While the invention has been described in detail with respect to specific embodiments, it will be appreciated that there are variations of, and equivalents to these embodiments. Accordingly, the scope of the present invention should be determined by the appended claims and any equivalents thereto.

What is claimed is:

1. A method of spraying a liquid in patterns on a moving web, the method comprising:

directing at least one intermittent spray of liquid onto the web to form a pattern on the web;

sensing a position of a leading edge of at least one of the spray and the pattern relative to one or more references on the web;

generating a first correction signal when the leading edge of the pattern is out of position relative to the one or more references;

adjusting the spray of liquid in response to the first correction signal to correctly position a leading edge of a subsequent pattern relative to one or more subsequent references on the web;

sensing a position of a trailing edge of at least one of the spray and the pattern relative to one or more references on the web;

generating a second correction signal when the trailing edge of the pattern is out of position relative to the one or more references; and adjusting the spray of liquid in response to the second correction signal to correctly position a trailing edge of subsequent patterns relative to one or more subsequent references on the web.

2. The method of claim 1 wherein sensing a position of a leading edge of at least one of the spray and the pattern includes sensing a position of a leading edge of the one pattern relative to a first reference on the web, and sensing a position of a trailing edge of at least one of the spray and the pattern includes sensing a position of a trailing edge of the one pattern relative to a second reference on the web.

3. The method of claim 1 sensing a position of a leading edge of at least one of the spray and the pattern relative to one or more references on the web includes sending signals to a control, and sensing a position of a trailing edge of at least one of the spray and the pattern relative to one or more references on the web includes sending signals to the control.

4. The method of claim 1 wherein generating a first correction signal includes calculating the first correction signal according to preprogrammed instructions within a control, and generating a second correction signal includes calculating the second correction signal according to preprogrammed instructions within the control.

5. The method of claim 1 wherein sensing a position of a leading edge of at least one of the spray and the pattern includes sensing the leading edge of the pattern on the web.

6. The method of claim 5 wherein sensing a position of a trailing edge of at least one of the spray and the pattern includes sensing the trailing edge of the pattern on the web.

7. The method of claim 6 wherein sensing the leading and trailing edges of the pattern includes sensing differences in thermal energy between the leading and trailing edges of the pattern and the web.

8. The method of claim 6 wherein sensing the leading and trailing edges of the pattern includes obtaining visual images of the pattern on the web.

9. The method of claim 1 wherein sensing a position of a leading edge of at least one of the spray and the pattern includes sensing a leading edge of the spray.

10. The method of claim 9 wherein sensing a position of a trailing edge of at least one of the spray and the pattern includes sensing a trailing edge of the spray.

11. The method of claim 9 wherein sensing a leading edge of the spray includes sensing a leading edge of the spray as the spray leaves a nozzle.

12. The method of claim 1 wherein directing at least one intermittent spray of liquid onto the web to form a pattern on the web includes directing a plurality of intermittent sprays of liquid onto the web.

13. The method of claim 12 wherein directing a plurality of intermittent sprays of liquid onto the web includes supplying a plurality of nozzles with liquid from a plurality of sources such that each nozzle has an individual source of liquid.

14. The method of claim 12 wherein directing a plurality of intermittent sprays of liquid onto the web includes directing intermittent sprays of different types of liquid.

15. A method of spraying a liquid in patterns on a web, the method comprising:

sending signals to a nozzle;

spraying patterns of liquid onto the web using the nozzle when the nozzle receives the signals;

measuring a delay between sending the signals and spraying the patterns of liquid;

generating a correction factor based on the delay; and adjusting timing of the signals to the nozzle based on the correction factor.

16. The method of claim 15 wherein sending signals to a nozzle includes sending signals to a plurality of nozzles.

17. The method of claim 15 wherein spraying patterns of liquid onto the web using the nozzle includes spraying an adhesive onto the web using a plurality of nozzles.

18. The method of claim 15 wherein measuring a delay between sending the signals and spraying the patterns of liquid includes measuring an amount of time between sending a signal to spray on a pattern and sensing a portion of a spray that is generated by the nozzle based on the signal.

19. The method of claim 15 wherein generating a correction factor includes calculating the correction factor according to preprogrammed instructions within a control that sends the signals to the nozzle.

20. The method of claim 15 wherein measuring a delay between sending the signals and spraying the patterns of liquid further comprises:

measuring a speed of the web;

monitoring a first time when a signal is sent to the nozzle;

sensing a second time when a portion of a pattern that is generated by the signal passes a sensor that is at a fixed point relative to the moving web;

calculating a time difference between the first time and the second time;

calculating a web transport time, the web transport time being the amount of time it takes for a pattern on the web to move from the nozzle to the sensor; and subtracting the web transport time from the time difference to determine the delay.

21. The method of claim 20 wherein sensing a second time includes thermally sensing when a leading edge of a spray pattern that is generated by the signal passes the fixed point.

22. The method of claim 20 wherein calculating a time difference includes calculating the time differences according to preprogrammed instructions within a control that sends signals to the nozzle.

23. The method of claim 22 wherein subtracting the web transport time from the time difference to determine the delay includes subtracting the web transport time from the time difference according to preprogrammed instructions within a control that sends the signals to the nozzle.

24. A method of spraying a liquid in patterns on a web, the method comprising:

sending an on signal to a mechanism;

spraying a pattern of liquid onto the web using the mechanism when the mechanism receives the on signal;

measuring an on delay between sending the signal to the mechanism and the mechanism spraying the pattern of liquid based on the on signal;

generating a first correction factor that correlates to the on delay;

adjusting timing of subsequent on signals to the mechanism based on the first correction factor;

sending an off signal to the mechanism;

stopping the spraying of liquid onto the web when the mechanism receives the off signal;

measuring an off delay between sending the off signal to the mechanism and the mechanism stopping the spray of liquid based on the off signal;

generating a second correction factor that correlates to the off delay;

adjusting timing of subsequent off signals to the mechanism based on the second correction factor.

25. The method of claim 24 wherein measuring an on delay includes measuring an amount of time between when the on signal is sent to the mechanism and the spray leaves the mechanism, and measuring an off delay includes measuring an amount of time between when the off signal is sent to the mechanism and the spray stops leaving the mechanism.

26. The method of claim 24 wherein measuring an on delay includes measuring an amount of time between when the on signal is sent to the mechanism and the leading edge of the pattern is monitored by a sensor, and measuring an off delay includes measuring an amount of time between when the off signal is sent to the mechanism and the trailing edge of the pattern is monitored by a sensor.

* * * * *